United States Patent [19]

Ferrero

[11] 4,408,690

[45] Oct. 11, 1983

[54] BEVERAGE CONTAINER PIERCEABLE BY A DRINKING STRAW

[75] Inventor: Giovanni Ferrero, Pino Torinese, Italy

[73] Assignee: Ferrero S.p.A., Alba, Italy

[21] Appl. No.: 387,251

[22] Filed: Jun. 10, 1982

[30] Foreign Application Priority Data

Jun. 12, 1981 [IT] Italy ..... 67815 A/81
Jan. 4, 1982 [IT] Italy ..... 67001 A/82

[51] Int. Cl.[3] ..... B65D 25/08; B65D 51/22; B01F 7/16

[52] U.S. Cl. ..... 206/222; 366/154; 229/7 S; 215/1 A; 206/603; 206/219

[58] Field of Search ..... 206/219, 222, 603; 229/7 S; 215/1 A; 366/150, 154, 155, 168, 169, 332, 349; 239/33; 145/53, 54; 46/68

[56] References Cited

U.S. PATENT DOCUMENTS

| | | | |
|---|---|---|---|
| 400,547 | 4/1889 | Crafton | 145/53 |
| 407,842 | 7/1889 | Schuermann | 145/53 |
| 2,631,521 | 3/1953 | Atkins, Jr. | 99/275 |
| 2,721,552 | 10/1955 | Nosik | 206/222 |
| 2,786,769 | 3/1957 | Greenspan | 426/117 |
| 2,849,321 | 8/1958 | Lhermitte et al. | 206/603 |
| 2,884,709 | 5/1959 | Kruger | 46/68 |
| 2,979,267 | 4/1961 | Miller | 239/33 |
| 3,134,577 | 5/1964 | Bollmeier | 206/222 |
| 3,144,966 | 8/1964 | Cook | 222/136 |
| 3,240,391 | 3/1966 | Garton | 206/222 |
| 3,346,187 | 10/1967 | Mueller | 239/33 |
| 3,349,966 | 10/1967 | Schwartzman | 222/80 |
| 3,404,811 | 10/1968 | Cernei | 222/83 |
| 3,548,562 | 12/1970 | Schwartzman | 53/440 |
| 3,655,096 | 4/1972 | Easter | 206/222 |
| 3,692,487 | 9/1972 | Sanz | 422/67 |
| 4,193,698 | 3/1980 | Gartner | 366/130 |

FOREIGN PATENT DOCUMENTS 2632488 7/1976 Fed. Rep. of Germany .

*Primary Examiner*—William T. Dixson, Jr.
*Assistant Examiner*—Brenda J. Ehrhardt
*Attorney, Agent, or Firm*—Bernard, Rothwell & Brown

[57] ABSTRACT

The body (1) of the container is provided with a frangible internal diaphragm (4) which sub-divides it into two superimposed chambers (1*b*, 1*c*), one containing a beverage and the other containing an additive substance. Above the diaphragm (4), in the body (1) of the container, is mounted a cutting tool (5) having at least one cutting edge (*7a*) facing the diaphragm (4), which is engageable by a drinking straw (11) in the first stage of the introduction of the straw (11) into the container, and can pierce the diaphragm (4) due to its being driven by the straw (11). The substance in the upper chamber (1*b*) falls under gravity through the pierced diaphragm (4) into the lower chamber (1*c*), in which it mixes with the other substance under the action of the cutting tool (5) which rotates due to the axial sliding of a threaded portion (13) of the straw (11) in a nut carried by the body (1) of the container in the zone of introduction of the straw (11).

11 Claims, 4 Drawing Figures

BEVERAGE CONTAINER PIERCEABLE BY A DRINKING STRAW

The present invention relates to containers for beverages, and is particularly concerned with a container comprising a body having an upper end wall at least one part of which is pierceable by a drinking straw.

Containers of this type are known and generally used for containing a thirst-quenching drink, such as tea, orange juice or the like, in which the user can pierce the upper end wall of the container (or a part of this end wall) by means of a plastics drinking straw to allow the beverage to be drawn up. The problem behind the invention is that of providing a container of the aforesaid type, which is able to contain, in addition to the beverage, a measure of an additive substance for adding to the beverage only at the moment of consumption, and which, in order to bring the beverage and the additive substance into contact with each other and to mix them, does not require additional operations beyond those of piercing the upper end wall of the container with the straw and introducing the straw into the container until it is close to the bottom.

In order to solve this problem, the present invention has for its subject a beverage container of the type specified above, characterised in that:

the body of the container is provided with a frangible internal diaphragm which sub-divides the container into two superimposed chambers, one containing the beverage and the other containing an additive substance;

in the body of the container, above the diaphragm, is mounted a cutting tool having at least one cutting edge facing the diaphragm, which is engageable by the straw in the first stage of the introduction of the straw into the body of the container and which can pierce the diaphragm due to its being driven by the straw, and the pierceable part of the container is provided with a nut of large pitch and the straw has a threaded portion with threading corresponding to that of the nut, whereby, after engagement by the end of the straw, the cutting tool rotates due to the axial sliding of the threaded portion of the straw in the nut, promoting the mixing of the beverage and the additive substance.

By virtue of this characteristic, the problem of piercing the diaphragm with a reduced force on the part of the user to allow the contents of the upper chamber (usually the additive substance) to flow by gravity into the lower chamber where they mix rapidly with the contents of this chamber (usually the beverage), due to the rotation of the cutting tool produced by the axial sliding of the threaded portion of the straw in the nut, is resolved in a very simple and efficient manner.

The container according to the invention is particularly suitable for packaging effervescent drinks or cocktail mixes.

In the first case, the lower chamber of the container holds a drink, while the upper chamber contains effervescent powder. Alternatively, the lower chamber may contain an acid-type drink while the upper chamber contains a basic powder. The mixing of the drink with the effervescent agent immediately before consumption eliminates the need to use containers of rigid plastics material or pressure resistant sheet metal for packaging the drink.

In the case of cocktail mixes, the lower chamber of the container may hold a fruit-based drink, while the upper chamber contains an alcoholic syrup for mixing with the drink to prepare a beverage of the type generally known as a "long drink".

The use of a cutting tool for piercing the internal diaphragm is particularly advantageous when, according to a preferred embodiment of the invention, the diaphragm itself is formed from two superimposed sheets, each of which constitutes a wall of a respective chamber of the container.

The invention will now be described, purely by way of non-limiting example, with reference to the appended drawings, in which.

Figure 1:
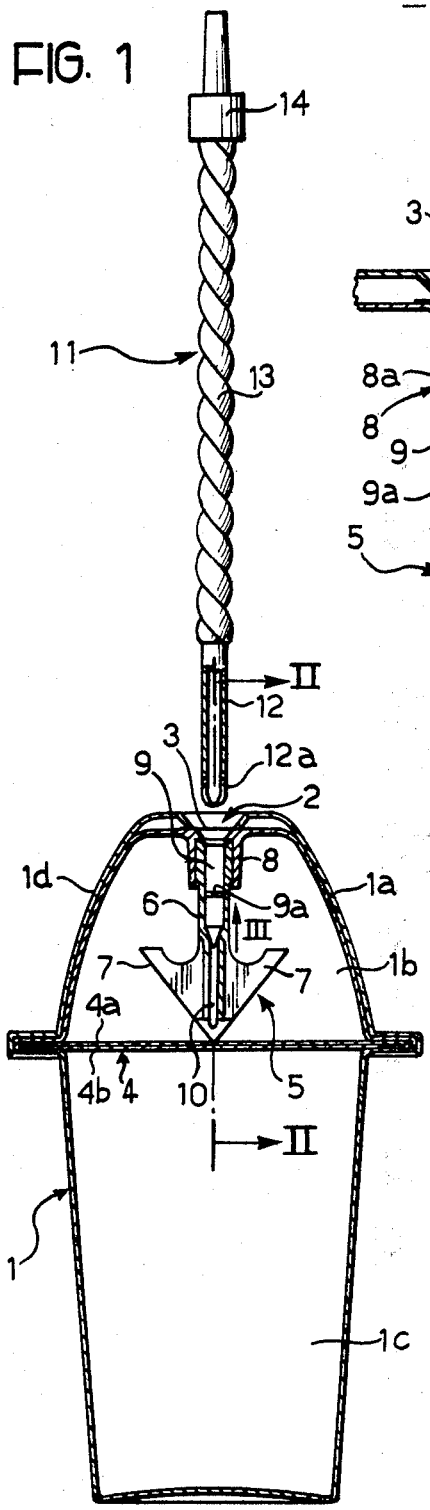
FIG. 1 is an elevational view, in partial axial section, of a container according to the invention.
Figure 2:
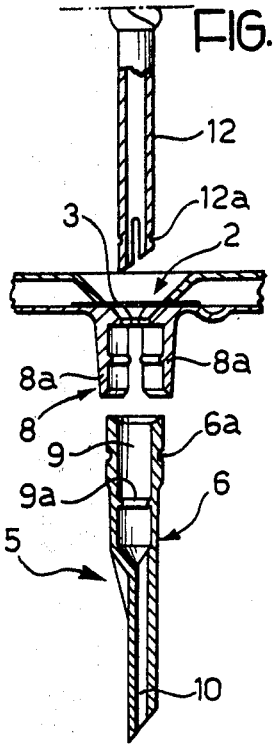
FIG. 2 is a section on an enlarged scale taken on the line II—II of FIG. 1.
Figure 4:
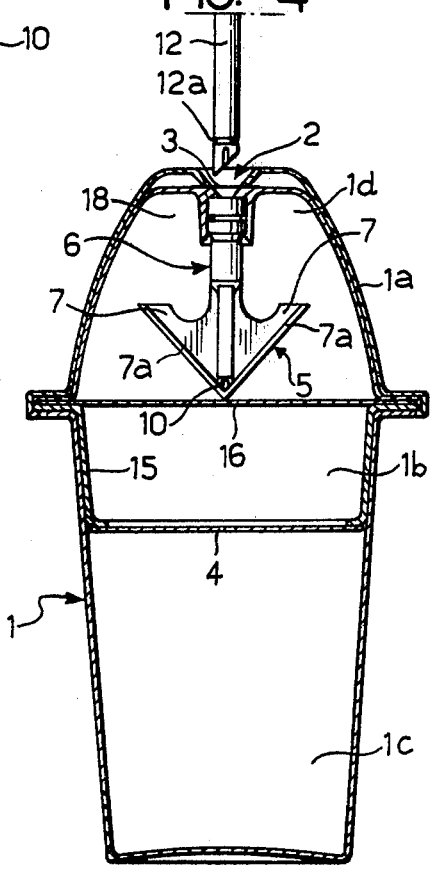
FIG. 4 is an elevational view, substantially similar to FIG. 1, of another container according to the invention.

In FIGS. 1 and 4, a hollow body, generally indicated by 1, comprises a lower beaker part and a domed top 1*a* having a central aperture 2 provided with a seal 3 which is easily broken.

The top 1*a* has a flanged edge which allows its connection to the remaining part of the body 1, which is provided with a corresponding flanged edge, with the interpositioning of a frangible internal diaphragm 4 which sub-divides the interior of the body 1 into two superimposed chambers 1*b*, 1*c*, respectively.

The lower chamber 1*c* is intended to contain a beverage, such as a fruit-based drink, while the upper chamber 1*b* is intended to contain an additive substance, such as an alcoholic syrup, which must be brought into contact with the beverage only at the moment of use of the container.

Within the upper chamber 1*b* is mounted a cutting tool, generally indicated 5, comprising a central hub 6 and a pair of triangular blades 7 which extend radially from the hub 6.

The blades 7 have cutting edges 7*a* which converge towards the diaphragm 4 so as to give the tool 5 the appearance of an arrow.

The cutting edges 7*a* together form an angle of less than 120°, preferably less than 90°.

The end of the hub 6 which faces the diaphragm 4 is tapered and has a pointed apex portion connected with the cutting edges 7*a*.

Figure 3:
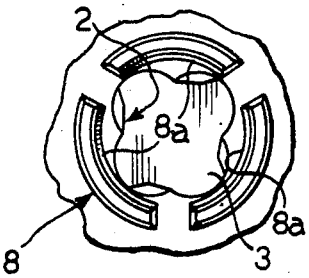
FIG. 3 is a view taken on arrow III of FIG. 1.

The opposite end of the hub 6 is housed in a tubular projection 8 which surrounds the aperture 2, the profile of which is shaped so as to form a nut with a large pitch (FIG. 3).

The hub 6 has an axial cavity 9 which communicates with the outer surface of the hub 6 close to the pointed apex portion through a duct 10 of restricted section.

A drinking straw, generally indicated 11, is intended to be introduced axially through the aperture 2 at the moment of use of the container according to the invention.

The straw 11 includes an end portion 12 receivable in the axial cavity 9 of the hub 6, and an intermediate threaded portion 13 with a large-pitch thread corresponding to that of the nut formed by the aperture 2. Preferably, this thread is of the multi-start type.

The end portion 12 of the straw 11 has a circumferential groove 12*a* for receiving a corresponding annular projection 9*a* on the wall of the axial cavity of the hub 6. Thus, when the end 12 of the straw 11 is coupled with the hub 6 of the cutting tool 5, the axial sliding of the tool and its disengagement from the straw 11 are prevented.

The coupling of the hub 6 and the tubular projection 8 is effected through complementary engagement surfaces such that the force to be exerted axially on the straw 11 to cause the disengagement of tool 5 from the projection 8 is greater than the force required to effect complete coupling of the end 12 of the straw 11 with the hub 6.

Preferably, the tubular projection 8 is sub-divided into a plurality of resilient segments provided on their inner surfaces (FIG. 3) with circumferential projections 8*a* which engage a corresponding groove 6*a* in the outer surface of the hub 6.

The straw 11 is provided, close to the end opposite the body 1, with a collar 14 which is freely rotatable about the straw 11. The collar 14 facilitates the handling of the straw 11 when the straw itself rotates due to the axial sliding of its threaded portion 13 in the nut formed by the aperture 2, causing the rotation of the tool 5 which acts as a mixer.

In the embodiment illustrated in FIG. 1, the diaphragm 4 is constituted by two superimposed aluminium sheets the first of which, indicated 4*a* acts as a bottom wall for the chamber 1*b*, while the second, indicated 4*b*, constitutes the upper wall of the chamber 1*c*.

On its side facing the chamber 1*b*, the sheet 4*a* has a coating of plastics material, such as polypropylene, identical to the material of the domed top 1*a*, which allows its attachment by heat-sealing of the flanged edge of the top.

Similarly, the sheet 4*b* is provided on its side facing the chamber 1*c* with a coating of material, such as polyethylene, which allows its attachment by heat-sealing to the flanged edge of the beaker part of the container body.

In the packaging of the container, the sheets 4*a*, 4*b* are applied as seals to the chambers 1*b*, 1*c* after the chambers themselves have been filled with their contents.

After the filling and sealing, the domed top 1*a* may be easily overturned and fixed, for example by glueing with a thermo-plastic (hot melt) adhesive, to the lower part of the container body.

Moreover, a decorative cap 1*d* which covers the top 1*a* may be snap-engaged with the peripheral flange formed on the body of the container. The cap 1*d* is formed of thin plastics material, such as polystyrene, which can easily be coloured or metallized.

In the embodiment illustrated in FIG. 4, the internal diaphragm 4 is supported circumferentially by the lower edge of an annular element 15 inserted into the body 1. Between the top 1*a* and the remaining part of the body of the container 1 is interposed an auxiliary diaphragm 16 which extends across the upper chamber 1*b* so as to sub-divide the chamber into an upper portion for housing the cutting tool 5, and a lower portion for holding the additive substance.

This second embodiment of the invention, which provides for the separation of the cutting tool 5 from the additive substance up to the moment of use, is particularly advantageous during the packaging of the container. Indeed, it allows the lower chamber 1*c* and the lower portion of the chamber 1*b* (of which the diaphragm 4 constitutes the bottom wall) to be filled in sequence with the beverage and the additive substance, the sealing of the beaker part of the body 1 by the auxiliary diaphragm 16, and the fitting onto this part of the top 1*a* containing the cutting tool 5, in a working cycle which is carried out solely in a vertical sense and does not require the overturning of parts.

As a possible alternative, instead of being supported by the annular element 15, the diaphragm 4 may be fixed peripherally, for example, by glueing, to a shoulder or circumferential projection on the inner wall of the body 1.

At the moment of use of the container, the straw 11 is introduced axially into the body of the container through the central aperture 2 of the top 1*a*, causing the seal 3 associated therewith to be pierced.

During the first stage of its penetration, the end 12 of the straw 11 engages the axial cavity in the hub 6 of the cutting tool 5.

In the embodiment illustrated in FIG. 1, after coupling with the tool 5, the straw 11 continues its axial movement and drives the cutting tool 5, causing the piercing of the diaphragm 4 and the consequent fall of the additive substance from the chamber 1*b* into the underlying chamber 1*c* in which the beverage is located.

In the embodiment illustrated in FIG. 4, after coupling with the cutting tool 5, the straw 11 drives the tool 5 which pierces the auxiliary diaphragm 16 to penetrate the lower portion of the chamber 1*b*. In continuing its course, the cutting tool 5 also pierces the diaphragm 4 causing the additive substance to fall into the lower chamber 1*c* containing the beverage.

In both cases, the mixing of the additive substance and the beverage, having been brought into contact with each other, is achieved by virtue of the rotation of the cutting tool 5 produced by the axial sliding of the threaded portion 13 of the straw 11 in the nut associated with the aperture 2.

In the embodiment of FIG. 1, and in the embodiment of FIG. 4, the presence of the cutting edges 7*a* and the general arrow-shaped configuration of the cutting tool 5 allow the diaphragm 4 (and possibly the auxiliary diaphragm 16) to be pierced with the application of a modest axial force on the straw (which is normally of polypropylene), even when the diaphragm and the auxiliary diaphragm have relatively high mechanical resistances to perforation.

Naturally, while the principle of the invention remains the same, the details of construction and forms of embodiment may be varied widely from that described and illustrated. In particular, individual elements of each embodiment illustrated in the appended drawings may be freely applied to the other illustrated embodiment as well, without thereby departing from the scope of the present invention.

I claim:

1. A container for beverages, comprising a body having an upper end wall at least part of which is pierceable by a drinking straw, wherein the improvements consist in:

the body of the container having a frangible internal diaphragm which sub-divides the container into two superimposed chambers, one for containing a beverage and the other for containing an additive substance;

a cutting tool being mounted in the body of the container above the diaphragm, the cutting tool having at least one cutting edge facing the diaphragm and being engageable by an end of the straw, in the first stage of the introduction of the straw into the body of the container, to cause piercing of the diaphragm due to the tool being driven by the straw, and the pierceable part of the container being provided with a nut of large pitch and the straw having a threaded portion with threading corresponding to the threading of the nut, whereby, after its engagement by the end of the straw, the cutting tool is rotated due to the axial sliding of the threaded portion of the straw in the nut, promoting the mixing of the beverage and the additive substance.

2. A container as defined in claim 1, wherein the frangible internal diaphragm is formed from two superimposed sheets, each sheet constituting a wall of a respective chamber of the container body.

3. A container as defined in claim 1, wherein it further includes an auxiliary diaphragm which defines within the body of the container a further chamber containing the cutting tool.

4. A container as defined in claim 1, wherein the cutting tool includes a central hub for coupling with the end of the straw when the latter is introduced into the body of the container, and a plurality of blades extending radially from the central hub and having cutting edges which converge in pairs towards the diaphragm to give the tool an arrow shape.

5. A container as defined in claim 4, wherein the cutting edges of each pair of blades converge at an angle of less than 120°.

6. A container as defined in claim 4, wherein the cutting edges of each pair of blades converge at an angle of less than 90°.

7. A container as defined in claim 4, wherein the central hub of the cutting tool defines an axial hole for receiving the end of the straw with interference, and wherein the axial hole and the end of the straw have complementary engagement surfaces arranged to prevent axial sliding of the hub relative to the end of straw and disengagement of the cutting tool from the straw.

8. A container as defined in claim 4, wherein it further includes a tubular projection extending within the body of the container in a position corresponding to the nut, at least a part of the central hub of the cutting tool being receivable in said tubular projection with interference.

9. A container as defined in claim 7 or claim 8, wherein the central hub of the cutting tool and the tubular projection have complementary engagement surfaces, whereby the force to be exerted axially on the straw to disengage the tool from the tubular projection is greater than the force which causes the complete coupling of the end of the straw with the hub of the cutting tool.

10. A container as defined in claim 7, wherein the central hub has a tapered end facing the diaphragm, said end being provided with an aperture which allows the contents of the container to be sucked out through the straw, when the latter is coupled to the cutting tool in use.

11. A container as defined in claim 10, wherein the tapered end of the hub has a pointed apex portion and defines a duct of restricted section connecting the axial hole to the outer surface of the hub.

* * * * *